US005327146A

United States Patent [19]

Jeon

[11] Patent Number: 5,327,146

[45] Date of Patent: Jul. 5, 1994

[54] PLANAR ARRAY WITH RADIATORS ADJACENT AND ABOVE A SPIRAL FEEDER

[75] Inventor: Joo Sung Jeon, Seoul, Rep. of Korea

[73] Assignee: Goldstar Co., Ltd., Seoul, Rep. of Korea

[21] Appl. No.: 855,819

[22] Filed: Mar. 23, 1992

[30] Foreign Application Priority Data

Mar. 27, 1991 [KR] Rep. of Korea ..... 91-4789

[51] Int. Cl.[5] ..... H01Q 1/38; H01Q 21/24

[52] U.S. Cl. ..... 343/700 MS

[58] Field of Search ..... 343/700 MS, 795; H01Q 1/38, 21/06, 21/24

[56] References Cited

FOREIGN PATENT DOCUMENTS 55-97703 7/1980 Japan ..... 343/700 MS 57-87603 11/1980 Japan .

1294024 10/1972 United Kingdom ..... 343/700 MS

*Primary Examiner*—Michael C. Wimer

*Attorney, Agent, or Firm*—Morgan & Finnegan

[57] ABSTRACT

A dipole array antenna includes a conducting substrate, a feeder layer, and a dipole layer. The feeder layer is spirally formed by etching a first thin film on the foamed dielectric layer. The feeder layer is placed on a conducting substrate and a connector is attached to the feeder layer. The dipole layer is placed on a second foamed dielectric layer deposited on the feeder layer so as to prevent the energy loss of the feeder layer by etching a second thin film.

10 Claims, 3 Drawing Sheets

PLANAR ARRAY WITH RADIATORS ADJACENT AND ABOVE A SPIRAL FEEDER

FIELD OF THE INVENTION

The present invention concerns a dipole array antenna for receiving electro-magnetic wave signals transmitted via satellite, and more particularly a circularly polarized wave dipole array antenna comprising a plurality of dipoles and a feeder spirally arranged.

TECHNICAL BACKGROUND

Referring to FIGS. 1 and 2, a conventional dipole array antenna comprises a grounded conducting substrate 12, dielectric layer 11, feeder 13 formed in a straight line along a center line of the dielectric layer 11, plurality of dipoles 14 and 15 arranged opposed with each other across the feeder 13, impedance-matching load 16 attached to one end of the feeder 13, and connector 17 attached to the other end of the feeder 13. The angle ($\alpha$) formed between the feeder and dipoles 14, 15 is 45°. The length (La) of the dipoles 14, 15 is one half of the center frequency ($\lambda g$) of the antenna. The distance (Da) between the dipoles 14 and 15 opposed with each other across the feeder is $\lambda g/4$. The distance (Db) between adjacent dipoles (Da) in any of both sides of the feeder is $\lambda g$.

Since the angle ($\alpha$) between the dipoles and feeder is 45° and the distance (Da) between the opposed dipoles 14 and 15 is $\lambda g/4$, the dipoles 14 and 15 generates a circularly polarized wave forming circles from the end of the vector representing the magnitude and direction of the electric field in the planes perpendicular to the wave transmission direction, which is combined wholly in phase in view of remote electric field. In this case, the impedance-matching load 16 attached to the one end of the feeder 13 is to prevent the incident electro-magnetic waves from being reflected from the one end of the feeder due to the impedances being not matched. However, the impedance-matching load 16 separately attached to one end of the feeder 13 and the dipoles 14 and 15 being arranged along both sides of the feeder 13 formed in a straight line increase the size of the antenna.

In order to reduce the size of the antenna, there has been proposed a circularly polarized wave array antenna disclosed in Japanese Laid-Open Patent Publication Sho 57-87603 issued on Jun. 1, 1982, wherein the dipoles and feeder are spirally formed on the same plane, so that the dipoles interfere with the feeder to cause considerable energy loss.

SUMMARY OF THE INVENTION

It is an object of the present invention to reduce the size of a dipole array antenna.

It is another object of the present invention to provide a dipole array antenna comprising a plurality of dipoles and a feeder, wherein the plurality of dipoles are isolated from the feeder so as to minimize the energy loss.

It is still another object of the present invention to provide a dipole array antenna including a resonator instead of the impedance-matching load so as to increase the gain of the antenna.

According to the present invention, there is a dipole array antenna comprising a conducting substrate, a feeder layer, and a dipole layer. The feeder layer is spirally formed by etching a first thin film on the foamed dielectric layer. The feeder layer is placed on a conducting substrate and a connector is attached to the feeder layer. The dipole layer is placed on a second foamed dielectric layer deposited on the feeder layer so as to prevent the energy loss of the feeder layer by etching a second thin film.

The present invention will now be described more specifically with reference to the drawings attached only by way of example.

BRIEF DESCRIPTION OF THE ATTACHED DRAWINGS

FIG. 1 schematically shows the structure of a conventional dipole array antenna;

Figure 7:
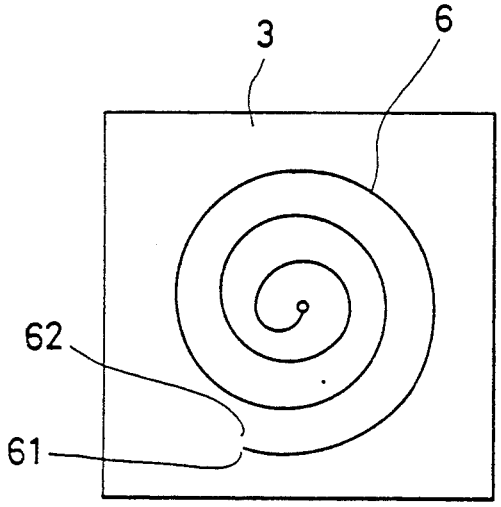
Figure 8:
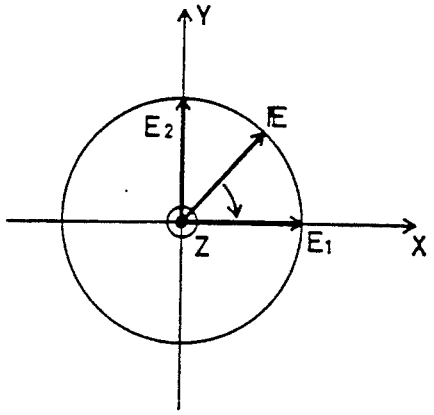

FIG. 7 schematically shows the feeder spirally arranged in the inventive dipole array antenna; and FIG. 8 shows coordinates for describing a circularly polarized wave taken by the inventive antenna.

DESCRIPTION OF THE INVENTION

Figure 6:
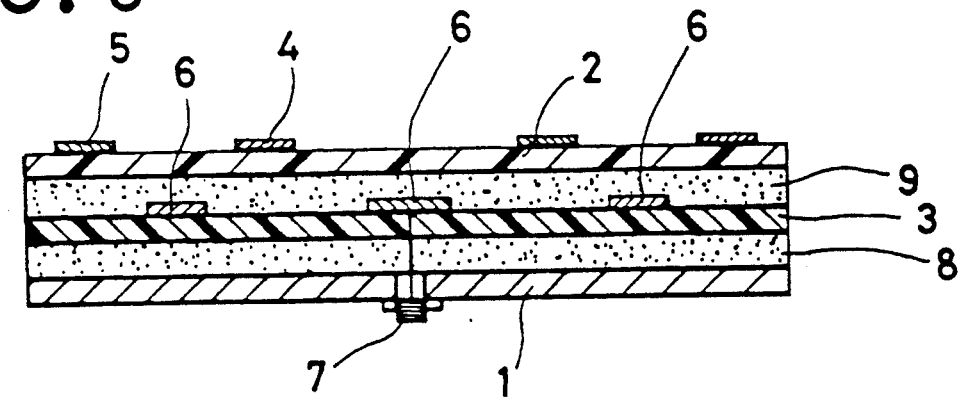
FIG. 6 is a cross-sectional view taken along line B—B of FIG. 3.

A thin film is obtained in a conventional manner. Feeder layer 3, which has feeder 6, is obtained by etching a thin film. Dipole layer 2, which has dipoles 4 and 5, is obtained by etching a thin film. As shown in FIG. 6, feeder layer 3 is placed on conducting substrate (ground layer) 1, and dipole layer 2 is placed on feed layer 3, and foamed dielectric layers 8 and 9 are located between dipole layer 2 and feeder layer 3 and between feeder layer 3 and substrate 1, respectively.

Figure 1:
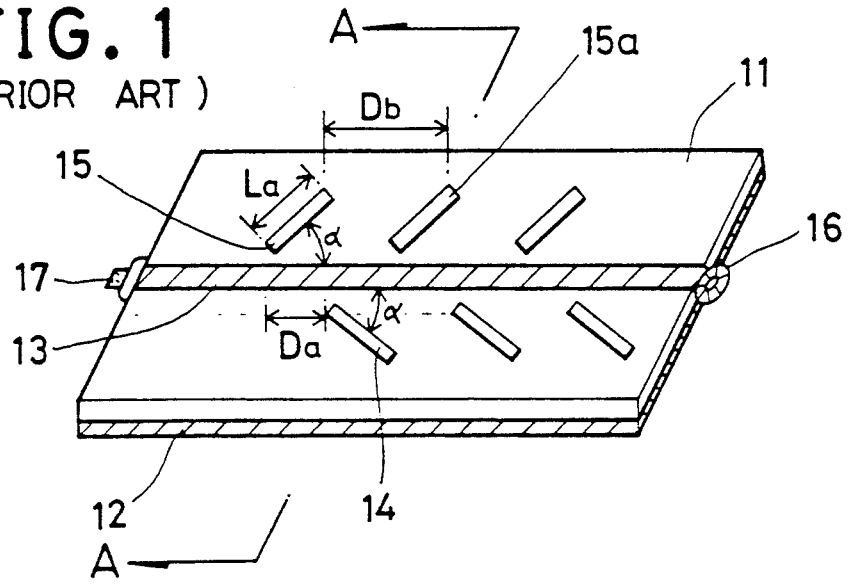
FIG. 1 ( PRIOR ART )
Figure 2:
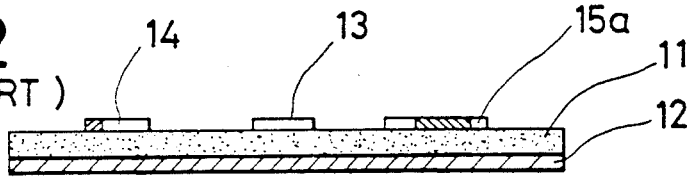
FIG. 2 ( PRIOR ART )
FIG. 2 is a cross-sectional view taken along line A—A of FIG. 1.
Figure 3:
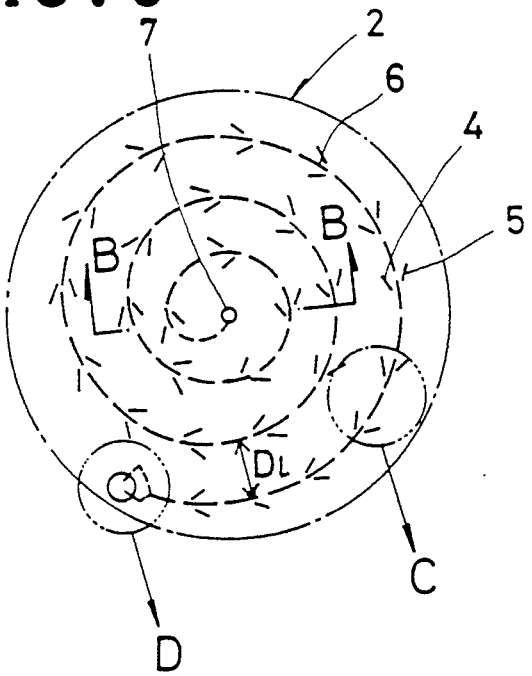
FIG. 3 illustrates a plane view of a dipole array antenna according to the present invention.
Figure 5:
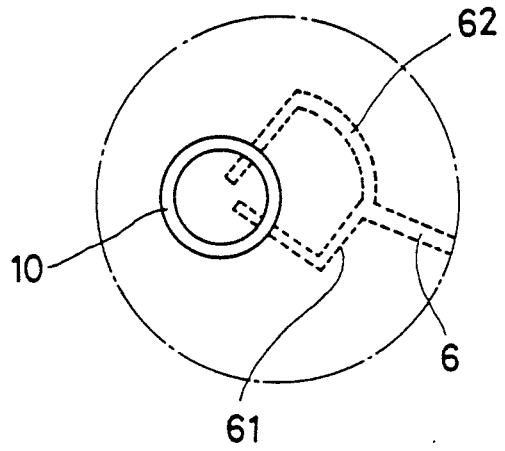
FIG. 5 is an enlarged view of the portion "D" of FIG. 3.

Referring to FIGS. 3 and 7, the feeder 6 is spirally formed with one end connected to a connector 7 as shown in FIG. 6 and the other end having first and second feeder-end portions 61 and 62, of which the lengths are respectively a fourth and a half of the center frequency ($\lambda g$) of the antenna as shown in FIG. 5.

Figure 4:
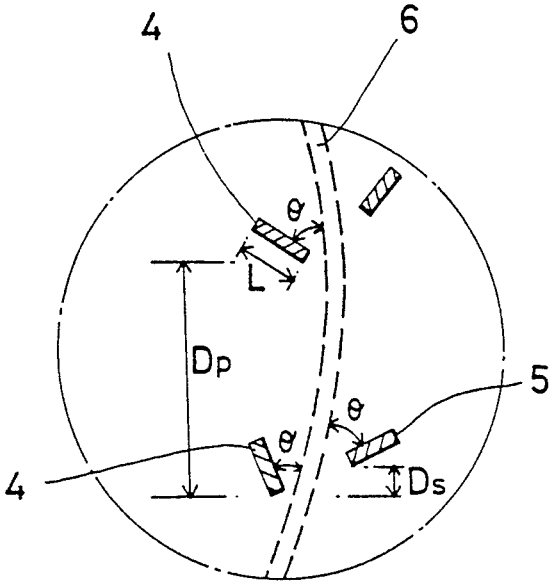
FIG. 4 is an enlarged view of the portion "C" of FIG. 3.

In addition, a resonator 10 is formed over the first and second feeder-end portions 61 and 62 by etching the second thin film 2. Internal and external dipoles 4 and 5 are formed over the spirally formed feeder 6, opposed with each other, as shown in FIG. 4, by etching the second film 2. The length (L) of the dipoles 4, 5 is a half of the center frequency $\lambda g$, the angle ($\theta$) formed between the feeder 6 and dipoles 4, 5 is 45°. The distance (Dp) between adjacent internal dipoles 4 is $\lambda g/2$. The position difference (Ds) between the opposed internal and external dipoles 4 and 5 is $\lambda g/4$, and the distance ($D_L$) between adjacent line portions of the feeder 6 is $\lambda g$.

In operation, since the angle formed between the internal and external dipoles 4 and 5 is 90° owing to the angle ($\theta$) being 45° circularly polarized waves are generated between the two dipoles 4 and 5, which are combined wholly in phase in view of the remote electromagnetic field.

The first and second feeder-end portions 61 and 62 respectively having the lengths of $\lambda g/4$ and $\lambda g/2$ which is formed below the resonator 10 with the isolating foamed dielectric layer 9 interposed therebetween have a phase differences of 90° with each other so as to form an antenna element to generate circularly polarized waves and achieve impedance-matching. Namely, without an additional impedance-matching load attached to the end of the feeder 6, the resonator 10 gives itself the impedance-matching.

A conventional antenna should have the trailing end grounded in order to achieve the impedance-matching between the leading and trailing ends, thus reducing the gain of the antenna. Or otherwise, it requires a separate impedance-matching load. However, the inventive antenna has the resonator 10 formed by etching the thin film 2 over the trailing end of the feeder 6, which resonator gives the impedance-matching so as to increase the gain of the antenna.

In this case, it is necessary for the plan antenna structure to receive the circular polarized waves employed in satellite communication. Hence, as shown in FIG. 8, the electro-magnetic waves moving in the "Z" direction are expressed by X and Y field components as follows:

$$Ex = E1 \text{ Sin } (wt - \beta t) \quad (1)$$

$$Ey = E2 \sin (wt - \beta t\delta) \quad (2)$$

Where E1 is the width of a linearly polarized wave in the X-direction, E2 the width of a linearly polarized wave in the Y-direction, and δ the time phase angle between Ey and Ex.

Then, the total vector field combining Eqs. (1) and (2) is expressed by the following Eq. (3):

$$E = xE1 \text{ Sin } (wt - \beta t) + yE2 \sin (wt - \beta t + \delta) \quad (3)$$

In Eq. (3), if E1=E2 and $\delta = \pm 90°$, a circularly polarized wave is produced. In this case, for $\delta = +90$ is produced a left circularly polarized wave and for $\delta = -90$ a right circularly polarized wave.

In this view, as shown in FIG. 5, the trailing end of the feeder 6 formed below the resonator 10 is made to consist of the first and second feeder-end portions 61 and 62 respectively having the lengths of λg/2 and λg/4 so as to give a phase difference of 90° thus producing circularly polarized waves. In addition, the position difference (Ds) between the opposed dipoles 4 and 5 is made to have λg/4 so as to give a phase difference of 90° so that the circularly polarized waves may be received by the plan antenna in satellite communication.

The overall length of the feeder 6 is determined according to the frequency of the received signals. In this case, the distance ($D_L$) between adjacent line portions of the feeder should be at least λg to prevent mutual interferences. Hence, the antenna of the smallest size should have the distance ($D_L$) to be λg. In this case, the length (L) of and distance (Dp) between the dipoles 4, 5 are also limited, and the length (L) should be λg/2 in order to receive the circularly polarized waves. The distance (Dp) also should be λg/2 because it is difficult to spirally arrange the dipoles with a smaller Dp and the gain of the antenna is reduced with a greater Dp due to side lobe phenomena.

As stated above, the inventive dipole array antenna comprises the dipoles spirally arranged along the spirally formed feeder, and thus has a considerably reduced size compared to the conventional antenna comprising the dipoles arranged in a straight line along the straight line type feeder. Further, the dipoles 4, 5 are isolated from the feeder 6 by means of the second foamed dielectric layer 9 so as to reduce the energy loss of the feeder. In addition, the impedance-matching is achieved by the resonator without a separate impedance-matching load.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A dipole array antenna, comprising:

(a) a first foam dielectric layer deposited on a conducting substrate;

(b) a first thin film layer deposited on said first foam dielectric layer;

(c) a spirally shaped feeder element formed on said first thin film layer and having respective ends;

(d) a connector attached to one of said ends;

(e) a second foam dielectric layer deposited on said feeder element so as to prevent the energy loss of said feeder element; and (f) a second thin film layer deposited on said second foam layer and including a plurality of dipoles formed thereon.

2. A dipole array antenna as claimed in claim 1, wherein the other of said ends includes first and second feeder-end portions for cooperating with each other so as to produce circular polarized waves.

3. A dipole array antenna as claimed in claim 2, wherein the lengths of said first and second feeder-end portions are respectively λg/4 and λg/2, where λg represents the center frequency of said antenna.

4. A dipole array antenna as claimed in claim 2, wherein the lengths of said first and second feeder-end portions provide a phase difference of 90° between them.

5. A dipole array antenna as claimed in claim 1, wherein adjacent line portions of said spirally shaped feeder are spaced from one another by a distance of at least λg.

6. A dipole array antenna as claimed in claim 1, further comprising a resonator formed by etching said second thin film.

7. A dipole array antenna as claimed in claim 6, wherein said resonator is formed over said first and second feeder-end portions of said spirally shaped feeder.

8. A dipole array antenna as claimed in claim 1, wherein a 45° angle is formed between a surface of said spirally shaped feeder and said dipoles.

9. A dipole array antenna as claimed in claim 1, wherein said plurality of dipoles include dipoles being located on both sides of the spirally shaped element with adjacent dipoles on either side of said feed element being spaced from one another by a distance of λg/2.

10. A dipole array antenna as claimed in claim 9, wherein dipoles on opposite sides of said feeder are spaced from one another by a distance of λg/4.

* * * * *